US005956915A

United States Patent [19]

Piper et al.

[11] Patent Number: 5,956,915

[45] Date of Patent: Sep. 28, 1999

[54] TUBULAR DRILL MAST

[75] Inventors: James P. Piper, Oak Creek; Carl D. Gilmore, South Milwaukee; Kenneth W. Hammel, Greendale; Frank R. Szpek, Milwaukee, all of Wis.

[73] Assignee: Bucyrus International, Inc., South Milwaukee, Wis.

[21] Appl. No.: 08/881,337

[22] Filed: Jun. 24, 1997

Related U.S. Application Data

[60] Provisional application No. 60/020,856, Jun. 28, 1996.

[51] Int. Cl.[6] ..... E04H 12/00

[52] U.S. Cl. ..... 52/651.05; 52/112; 52/651.01; 52/690; 52/693

[58] Field of Search ..... 52/112, 651.01, 52/651.05, 651.06, 651.07, 651.09, 652.1, 690, 693

[56] References Cited

U.S. PATENT DOCUMENTS

| | | | |
|---|---|---|---|
| 3,360,288 | 12/1967 | Holscher | 52/651.09 |
| 3,371,458 | 3/1968 | Sturgill | 52/651.01 |
| 3,561,711 | 2/1971 | Dodge | 52/651.01 |
| 4,503,645 | 3/1985 | Nudd et al. | 52/651.01 |
| 4,595,066 | 6/1986 | Nelmark et al. | 175/85 |

FOREIGN PATENT DOCUMENTS

| | | | |
|---|---|---|---|
| 757674 | 8/1980 | U.S.S.R. | 52/651.07 |

*Primary Examiner*—Tamara L. Graysay
*Assistant Examiner*—Chi H. Kang
*Attorney, Agent, or Firm*—Quarles & Brady

[57] ABSTRACT

A drill mast has two tubular side chords and a central chord equally spaced from the side chords. The central chord is joined to the side chords by transverse and diagonal tubular lacing members. Space frames formed of tubular members extending from spheres are connected to each of the chords. The spheres are aligned along a line equidistant from the chords.

12 Claims, 6 Drawing Sheets

FIG. 5
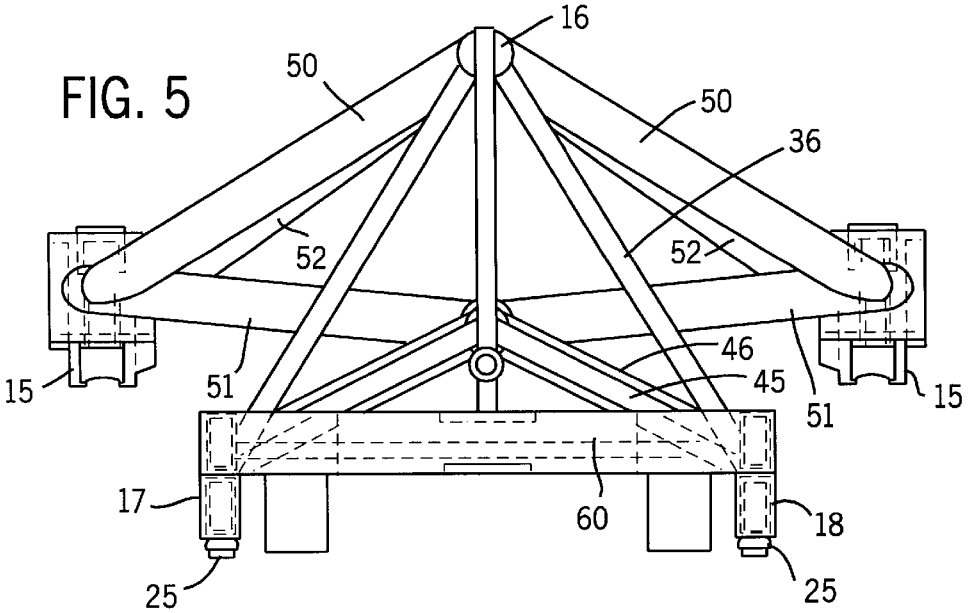
FIG. 6
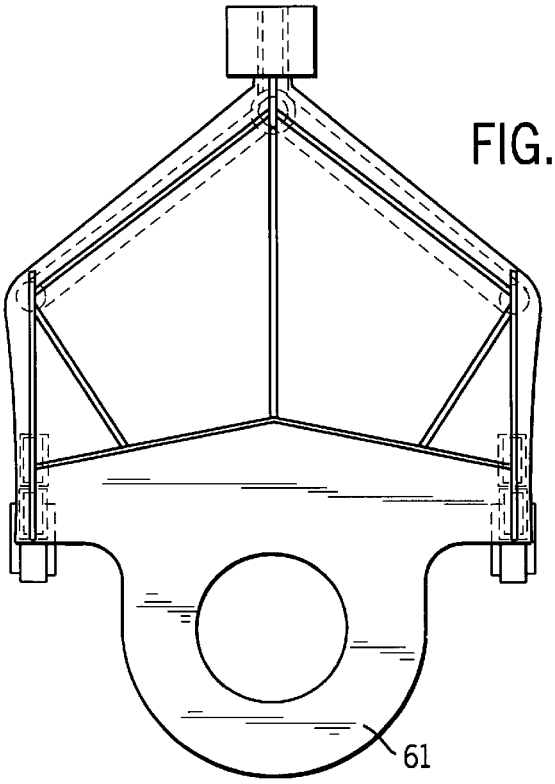
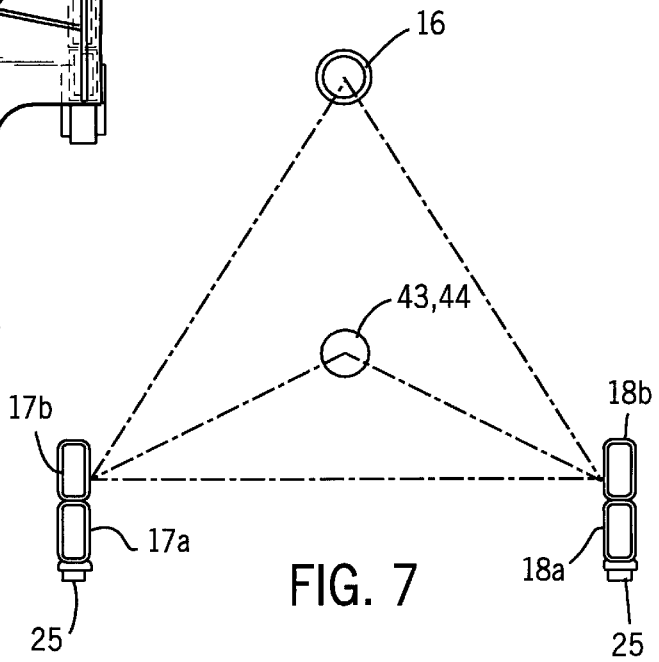
FIG. 7

TUBULAR DRILL MAST

BACKGROUND OF THE INVENTION

This application claims the benefit of U.S. Provisional Application No. 60/020,856 file Jun. 28, 1996.

This invention relates to drilling equipment, and particularly to a drill mast for use on mobile drilling units.

Mobile drilling units, such as blast hole drills, include a mast which supports the rotary drill head and the pull-down mechanism for the drill string. The masts are typically pivotally attached to a main deck so that the mast can be lowered to a generally horizontal position for transport and can be raised to a vertical or near vertical position for drilling.

The typical mast has taken the form of a box with one open side. The closed sides of the box are latticed. A pull-down mechanism that mounts a rotary drill head travels along spaced rails that form two comers of the open side of the box.

The present invention is directed to a drill mast which offers improved resistance to torsional and bending deflection and vibration created by the drilling, hoisting, and maneuvering of loads associated with the operation of a drill.

SUMMARY OF THE INVENTION

In its broadest sense, the invention is a drill mast consisting of three spaced parallel, longitudinal chords, together with lacing members joining together adjacent chords, the lacing members being arranged to form triangular panels.

More specifically, the invention is a drill mast comprising a pair of spaced, parallel longitudinal side chords and a central longitudinal chord equally spaced from and parallel to the side chords and transverse and diagonal lacing members joining the chords together along their length, the lacing members forming triangular panels.

Preferably, the mast is formed from tubular components welded together to create a three-dimensional truss structure. All sides of the mast are closed. The two side chords define tracks for the pull-down mechanism. The lacing joining these two side chords extends inwardly to provide a space to accommodate components that travel the length of the mast.

Three-dimensional steel bodies such as spheres are preferably used at the intersections of the lacing members to facilitate welding.

It is a principal object of the invention to provide an improved drill mast having high resistance to torsional and bending deflection and vibration.

It is another object of the invention to provide a drill mast formed of a three-dimensional truss structure with all sides closed, and with space to accommodate components traveling along the length of the mast.

The foregoing and other objects and advantages of the invention will appear in the following detailed description. In the description, reference is made to the accompanying drawings which illustrate a preferred embodiment of the invention.

BRIEF DESCRIPTION OF THE DRAWINGS

FIG. 5 is an end view of the mast viewed from the right end of FIGS. 2 through 4;

FIG. 6 is an end view of the mast viewed from the left end of FIGS. 2 through 4;

FIG. 7 is a schematic view of the cross-section of the mast;

DETAILED DESCRIPTION OF THE PREFERRED EMBODIMENT

Figure 1:
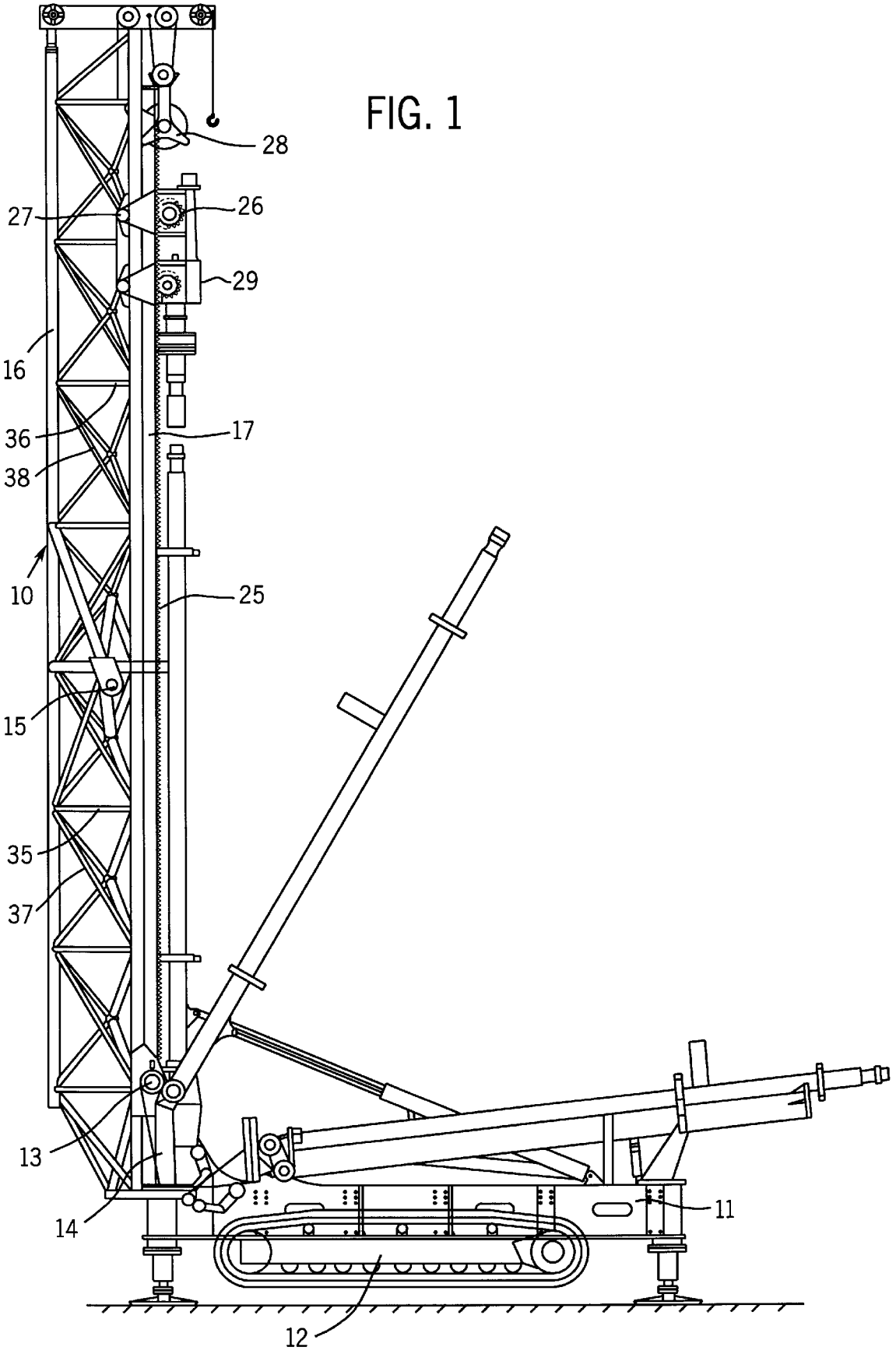
FIG. 1 is a view in elevation of a mobile blast hole drill unit incorporating the mast of the present invention.
Figure 2:
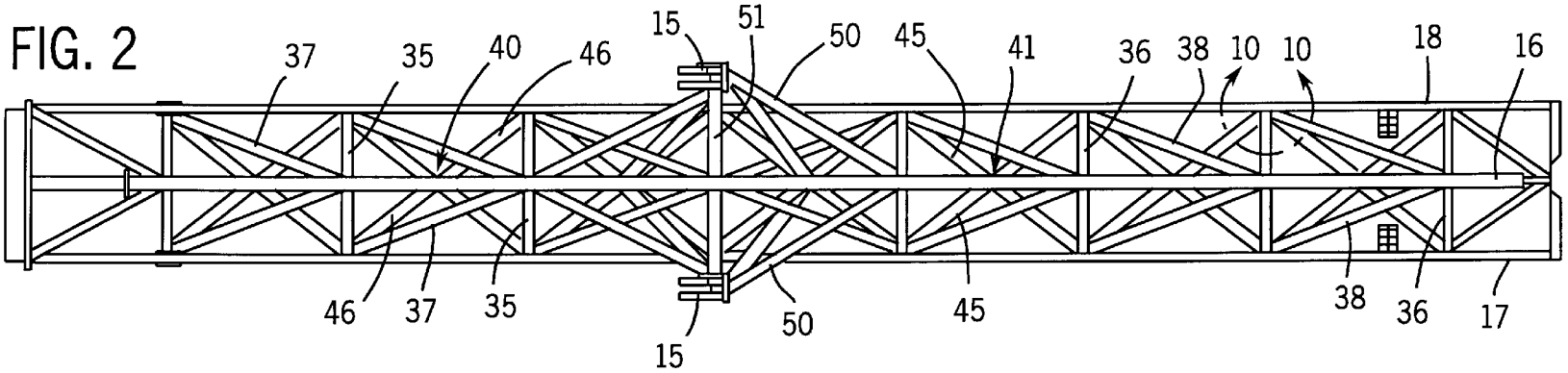
FIG. 2 is a top view of the mast.
Figure 3:
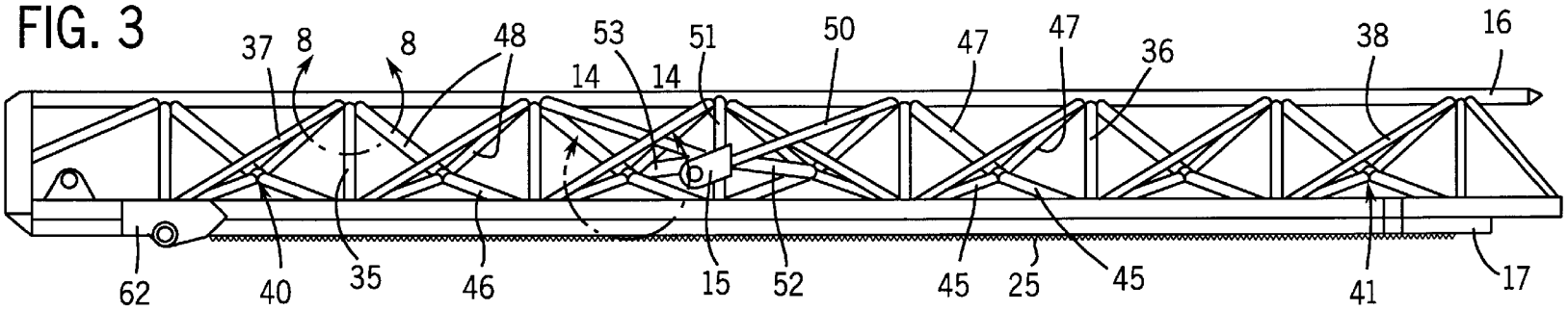
FIG. 3 is a side view of the mast.
Figure 4:
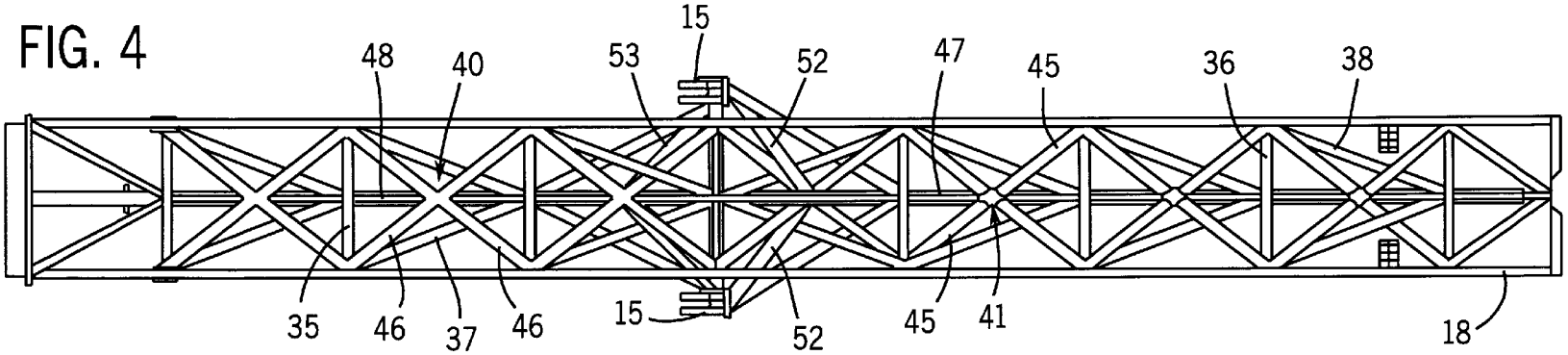
FIG. 4 is a bottom view of the mast.
Figure 8:
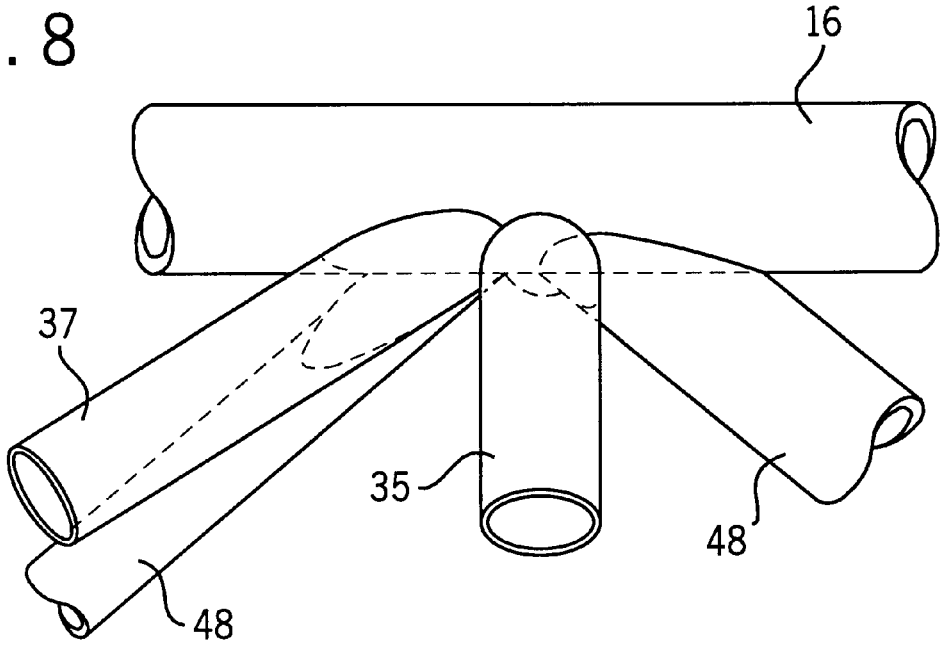
FIGS. 8 and 9 are, respectively, a side view and bottom view of an exemplary intersection of tubes with the central chord member.
Figure 9:
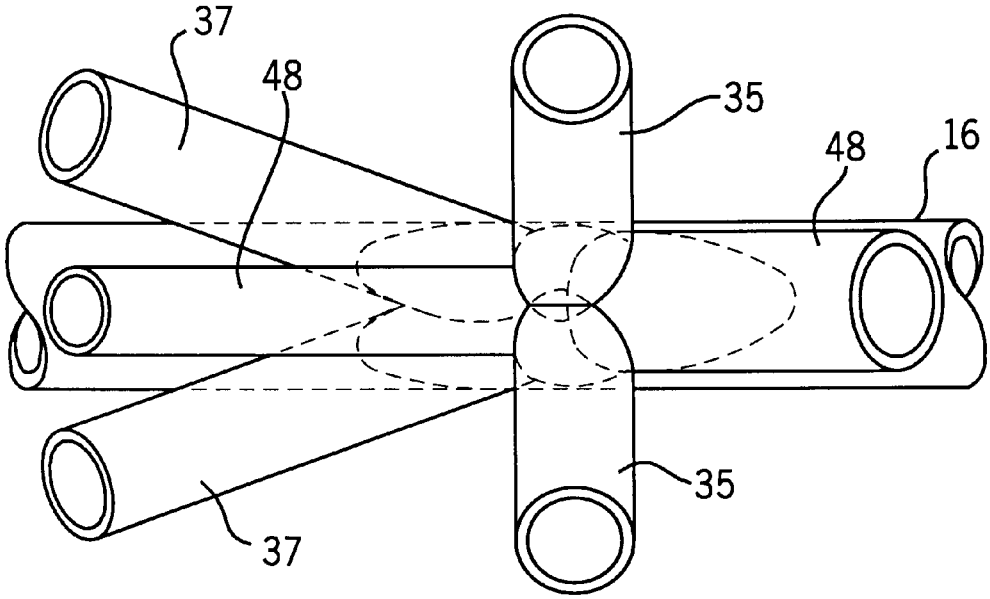
Figure 10:
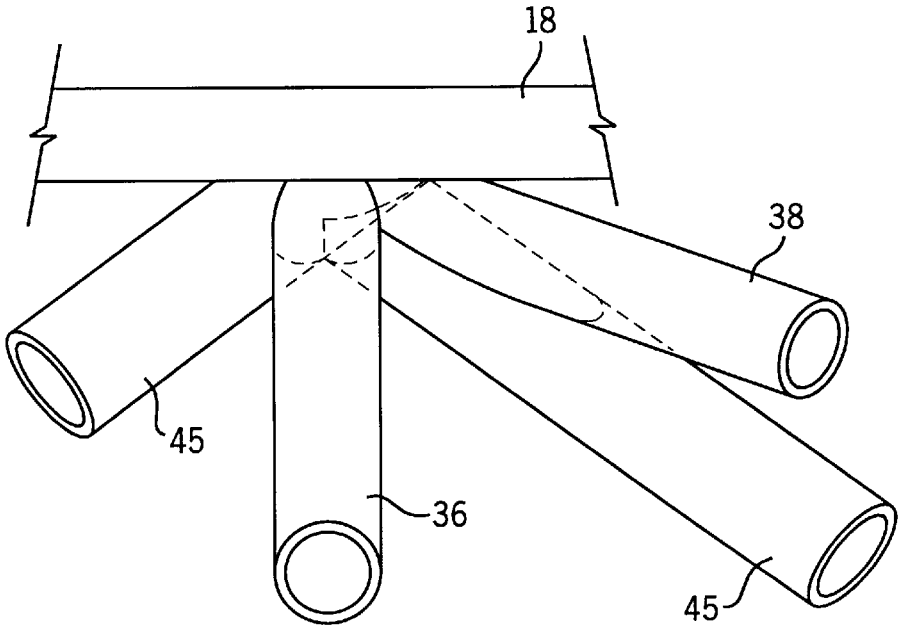
FIGS. 10 and 11 are, respectively, top and side views of an exemplary intersection of tubes with the side chords of the mast.
Figure 11:
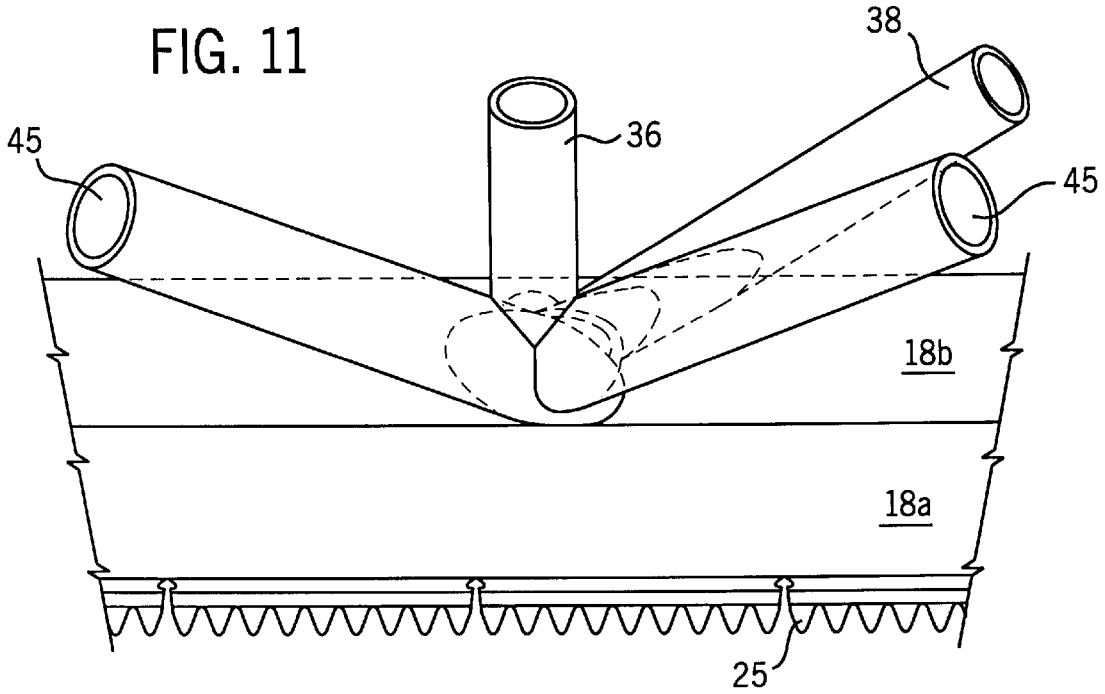

The mast 10 is intended to be used in conjunction with a blast hole drill having a main deck 11 mounted on a transport mechanism such as a crawler tractor 12. The lower end of the mast is mounted on pivot pins 13 held in a standard 14 which rises from the main deck 11. The mast 10 is adapted to be raised and lowered by a hydraulic cylinder (not shown) connected between the deck 11 and lugs 15 on either side of the mast 10. The mast 10 is formed with three longitudinal chords; a central chord 16 and side chords 17 and 18. The central chord 16 is formed of a heavy-walled circular steel tube. The side chords 17 and 18 are each formed of two rectangular steel tubes 17*a*, 17*b* and 18*a*, 18*b* welded together along their length.

One edge of each of the side chords 17 and 18 mounts gear tooth racks 25. The racks 25 are engaged by gears on a pull-down mechanism 26. The pull-down mechanism 26 includes rollers 27 which ride along the edge of the side chords 17 and 18 that is opposite that of the rack 25. A hydraulic hose carrier assembly 28 also travels along the length of the side chords 17 and 18. The pull-down mechanism 26 mounts a rotary drill head 29, in a known manner.

The central chord 16 is joined to the side chords 17 and 18 by a series of transverse steel tubes 35 and 36 and by a series of diagonal steel tubes 37 and 38. The transverse tubes 35 and diagonal tubes 37 below the lugs 15 are of heavier cross-section than that of the transverse tubes 36 and diagonal tubes 38 above the lugs 15. The transverse tubes 35 and 36 and the diagonal tubes 37 and 38 together with the chords 16, 17, and 18, form a series of triangular panels defining two sides of the mast 10.

Figure 12:
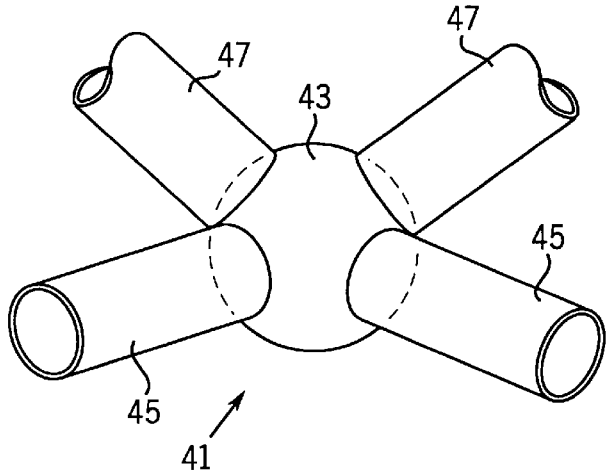
FIGS. 12, 13, and 14 are side views of typical connections of tube members to steel spheres.
Figure 13:
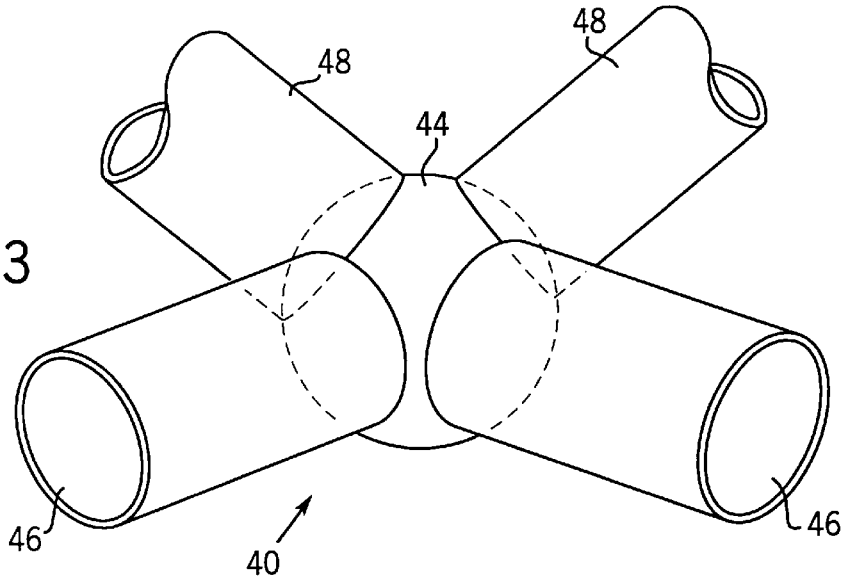
Figure 14:
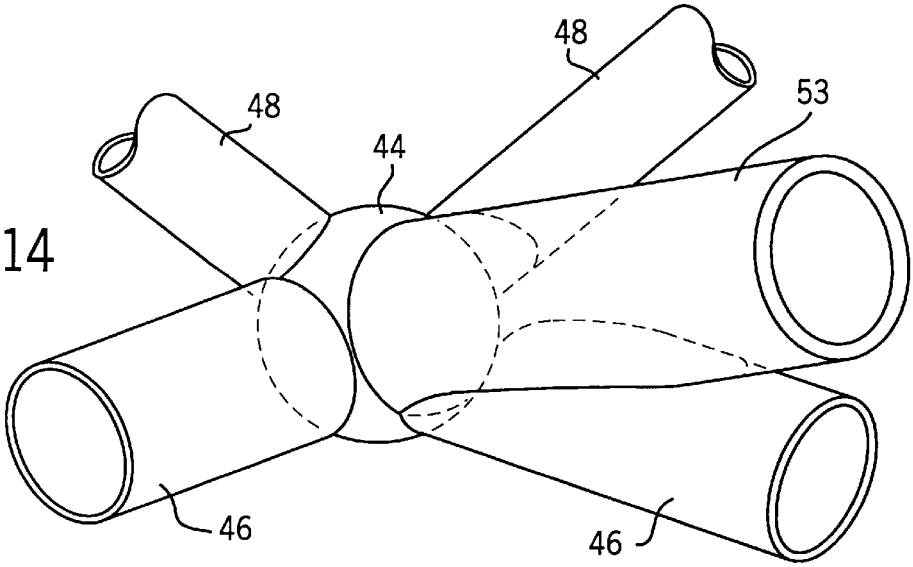

Space frames indicated generally by the numerals 40 and 41 are connected between the side chords 17 and 18 and beneath the central chord 16 to define the third side of the mast 10. As shown in FIGS. 12 and 13, the space frames 40 and 41 each include a solid steel sphere 43 or 44 to which is welded four steel brace tubes 45 or 46 which extend from the junction of the transverse tubes 35 or 36 with the side chords 17 and 18. The space frames 40 and 41 are completed by a pair of steel hanger tubes 47 or 48 which are also welded to the spheres 43 or 44. The hanger tubes 47 or 48 connect to the intersections of the transverse tubes 35, 36 with the central chord 16.

As shown in FIG. 7, the spheres 43 and 44 are centered along a line which is set in from the two side chords 17 and 18. The line of the spheres is preferably equidistant from each of the chords 16, 17, and 18. The result is the formation of a space which can accommodate hydraulic hosing or other components along the mast 10.

Additional tubular steel bracing is provided to mount the lugs 15 to the mast structure. Included are diagonal brace members 50 extending to the lugs 15 from the central chord 16, cross-brace members 51 and side brace members 52 and 53.

The upper end of the mast is closed by a channel 60 (see FIG. 5) while the lower end of the mast includes a fabricated sheet steel structure containing a mast drill deck plate 61 (see FIG. 6). Plates 62 are welded to the side chords 17 and 18 to receive the pivot pin 13.

We claim:

1. A drill mast, comprising:

a pair of spaced, parallel longitudinal side chords and a central longitudinal chord equally spaced from and parallel to the side chords;

transverse and diagonal lacing members joining the chords together along their length, the lacing members forming triangular panels; and three-dimensional bodies disposed equidistant between the side chords and to which the lacing members joining the side chords are connected.

2. A drill mast in accordance with claim 1 wherein the bodies are disposed within the triangle defined by the three chords.

3. A drill mast in accordance with claim 2 together with a track mounted along the length of each side chord.

4. A drill mast, comprising:

a pair of spaced, parallel tubular side chords and a central tubular chord that is equally spaced from and parallel to the side chords;

tubular lacing members joining the chords together along the length of the chords;

said lacing members including transverse and diagonal members defining triangular openings with the chords; and three-dimensional bodies disposed equidistant between the side chords and to which the lacing members joining the side chords are connected.

5. A drill mast in accordance with claim 4 wherein the lacing members joining the side chords are connected to spheres disposed intermediate the side chords.

6. A drill mast in accordance with claim 5 wherein the spheres are disposed in a line that is parallel to the chords and spaced equidistant from the chords.

7. A drill mast in accordance with claim 6 together with tracks mounted along the length of the side chords.

8. A drill mast in accordance with claim 5 wherein the chords, lacing members, and spheres are steel and are joined by welding.

9. A drill mast in accordance with claim 4 wherein the side chords are formed of rectangular tubes and the central chord is round.

10. A drill mast, comprising:

a pair of spaced, parallel tubular side chords and a central tubular chord that is equally spaced from and parallel to the side chords;

tubular transverse and diagonal lacing members joining the central chord to each of the side chords along the length of the chords; and frames joining the chords together along their length, the space frames being formed by diagonal tubular lacing members connected to the chords and to spheres disposed intermediate the side chords.

11. A drill mast in accordance with claim 10 wherein the spheres are disposed in a line that is parallel to the chords and spaced equidistant from the chords.

12. A drill mast in accordance with claim 11 wherein the side chords are formed of rectangular tubes and a track is mounted along the length of each side chord.

* * * * *